US009004982B2

(12) United States Patent
Salomon et al.

(10) Patent No.: US 9,004,982 B2
(45) Date of Patent: Apr. 14, 2015

(54) SUPPLY DEVICE FOR SPRAYING A CUTTING TOOL OF A HANDHELD POWER TOOL AND A POWER TOOL OF THIS TYPE

(75) Inventors: Gunnar Salomon, Hamburg (DE); Carsten Ziegs, Hamburg (DE)

(73) Assignee: Makita Corporation, Aichi (JP)

( * ) Notice: Subject to any disclaimer, the term of this patent is extended or adjusted under 35 U.S.C. 154(b) by 326 days.

(21) Appl. No.: 13/482,459

(22) Filed: May 29, 2012

(65) Prior Publication Data

US 2012/0312138 A1 Dec. 13, 2012

(30) Foreign Application Priority Data

Jun. 8, 2011 (DE) ..... 20 2011 050 396 U

(51) Int. Cl.

| | |
|---|---|
| ***B24B 55/02*** | (2006.01) |
| ***B24B 27/08*** | (2006.01) |
| ***B24B 55/04*** | (2006.01) |
| ***B24B 55/05*** | (2006.01) |

(52) U.S. Cl.
CPC ..... *B24B 55/052* (2013.01); *B24B 27/08* (2013.01); *B24B 55/045* (2013.01)

(58) Field of Classification Search
USPC ..... 451/342, 344, 352, 359, 449, 450, 451, 451/452, 453, 455; 125/13.01
See application file for complete search history.

(56) References Cited

U.S. PATENT DOCUMENTS

| | | | | |
|---|---|---|---|---|
| 3,896,783 | A * | 7/1975 | Manning | 125/13.01 |
| 4,022,182 | A | 5/1977 | Lenkevich | |
| 4,929,130 | A * | 5/1990 | Diebolt et al. | 409/136 |
| 5,826,478 | A * | 10/1998 | Zerrer | 83/169 |
| 7,520,799 | B2 * | 4/2009 | Wedel et al. | 451/450 |
| 7,713,111 | B2 * | 5/2010 | Layher et al. | 451/450 |
| 8,033,896 | B2 * | 10/2011 | Amend et al. | 451/454 |
| 2004/0042908 | A1 * | 3/2004 | Donnerdal | 417/229 |
| 2005/0034715 | A1 * | 2/2005 | Terpstra | 125/13.01 |
| 2006/0123638 | A1 * | 6/2006 | Wedel et al. | 30/346.58 |
| 2006/0128289 | A1 * | 6/2006 | Wedel et al. | 451/449 |
| 2010/0147278 | A1 | 6/2010 | Tadokoro et al. | |

FOREIGN PATENT DOCUMENTS

| | | |
|---|---|---|
| DE | 10 2005 044 297 | 5/2006 |
| DE | 102007032672 | 1/2009 |
| GB | 2419561 | 5/2006 |
| GB | 2450990 | 1/2009 |

(Continued)

OTHER PUBLICATIONS

Search report from United Kingdom, mail date is Jul. 27, 2012.

(Continued)

*Primary Examiner* — Eileen P. Morgan

(74) *Attorney, Agent, or Firm* — Greenblum & Bernstein, P.L.C.

(57) ABSTRACT

A supply device for a handheld power tool for a cutting grinder includes a cutting tool and a protective cover which at least partially surrounds the cutting tool. The supply device includes a U-shaped element which can be arranged on the protective cover and via which a fluid medium can be supplied to the cutting tool. The U-shaped element has a connection piece on which a coupling element can be arranged. On the coupling element a pipeline can be connected via which the fluid medium can be supplied to the U-shaped element through the connection piece. The coupling element can be turned about the axis of rotation of the connection pieces.

12 Claims, 3 Drawing Sheets

(56) References Cited

FOREIGN PATENT DOCUMENTS

| | | |
|---|---|---|
| GB | 2462468 | 2/2010 |
| JP | 2002/081016 | 3/2002 |

OTHER PUBLICATIONS

Search report from Germany, mail date is Mar. 23, 2012.

* cited by examiner

SUPPLY DEVICE FOR SPRAYING A CUTTING TOOL OF A HANDHELD POWER TOOL AND A POWER TOOL OF THIS TYPE

DESCRIPTION

The present invention relates to a supply device for a handheld power tool, more particularly a cutting grinder, with a tool and a protective cover, which at least partially surrounds the tool, whereby the supply device has a U-shaped element that can be arranged on the protective cover and via which a fluid medium can be supplied to the cutting tool.

PRIOR ART

DE 10 2005 044 297 A1 sets out a supply device for a handheld power tool and the power tool is in the form of a cutting grinder. The power tool is fitted with a cutting tool and a protective cover is provided that partially surrounds the cutting tool. The supply device has a U-shaped element that is arranged on the protective cover. The U-shaped element is in the shape of a U and surrounds the protective cover. The supply device also has at least one spray nozzle, with one spray nozzle being provided on each side of the protective cover. To supply the fluid medium to the U-shaped element a pipeline is required, whereby the pipeline takes the fluid medium to one of the two spray nozzles on the U-shaped element and whereby to supply the other spray nozzle the U-shaped element takes the fluid medium through a hollow area in the U-shaped element to the other spray nozzle. Disadvantageously, as a result of this the supply pressure of the two spray nozzles can be different so that the cutting tool is more exposed to the fluid medium on one side than on an opposite, second side. Furthermore, forces transmitted from the pipeline via the connection piece are introduced into the spray nozzle which can lead to failure of the arrangement, more particularly the spray nozzle can unscrew.

DESCRIPTION OF THE INVENTION: AIM, SOLUTION, ADVANTAGES

It is therefore the aim of the present invention to create a supply device which overcomes the disadvantages of the said prior art and which has a simplified arrangement of a U-shaped element, more particularly an improved connection with the pipeline.

This task is solved on the basis of a supply device for a handheld power tool in accordance with the introductory section of claim 1 in connection with the characterising features. Advantageous further developments of the invention are set out in the dependent claims.

The invention includes the teaching that the U-shaped element has a connection piece on which can be arranged the coupling element, whereby a pipeline can be connected to the coupling element via which the fluid medium can be supplied to the U-shaped element through the connection piece, whereby the coupling element is rotatable about an axis of rotation of the connection piece.

With the embodiment of the U-shaped element in accordance with the invention which has a connection piece on which a coupling element can be arranged, the pipeline no longer has to be connected to a spray nozzle of the U-shaped element. The connection piece can be provided on the U-shaped element in a simple manner, and the coupling element can be movably arranged on the connection piece. More particularly the connection piece can have an axis of rotation and the coupling element can be pivotable about the axis of rotation. In this way no bending or kinking forces can be transmitted from the pipeline to the U-shaped element as the coupling element, to which the pipeline is connected at its end, can turn so that a kink cannot form in the pipeline which could exert forces from the pipeline to the coupling element and cause damage to the connection between the coupling element and the U-shaped element. The rotation axis can project perpendicularly from the U-shaped element and the pipeline can, for example, rotate 360° about the axis of rotation, preferably at least in an angular range of 180° and particularly preferably in an angular range of 90°.

Preferably the connection piece is produced in one piece with the U-shaped element, whereby the connection piece with the U-shaped element can be produced in a joint plastic injection moulding step. This further reduces the number of individual parts for forming the supply device for supplying a fluid medium to the cutting tool of a power tool and the arrangement of the supply device on the protective cover des power tool can be further integrated.

Particularly advantageously the connection piece can have a regulating valve to adjust the flow quantity of the fluid medium through the supply device, whereby the fluid medium, can more particularly, be water. In this way the connection piece can be used to connect the coupling piece and/or to form and/or accommodate a regulating valve, which can be manually operated.

The regulating valve can, for example, comprise a valve pintle and a manually operated actuator, whereby the valve pintle can be formed by a part of the connection piece. More particularly, the valve pintle can form the end section of the connection piece which projects from the U-shaped element. Consequently the coupling element can be arranged close to the U-shaped element on the connection piece, and at the far end of the U-shaped element the actuator can be mounted on the connection piece. In this way the actuator can be easily manually operated and, for example, the flow of the fluid medium through the regulating valve can also be interrupted. More particularly the advantage is achieved that through the arrangement of the manually operated actuator the supply device on the protective cover of the power tool, the actuator is easily accessible, more particularly the actuator can be operated manually there where the user can also visually monitor the flow quantity of the fluid medium. Consequently, changing the flow quantity does not have to take place with an actuator arranged at a remote, first location, and the flow quantity of the fluid medium observed at a second location on the power tool, namely in the protective cover.

The connection piece can be rotationally symmetrical in design and can have a central axis forming the axis or rotation of the connection piece. In this way, the actuator, arranged at the end side on the valve pintle, which is formed by an end section of the connection piece, can also turn about the axis or rotation.

In accordance with an advantageous further development of the supply device according to the invention, the U-shaped element can have one and preferably two spray nozzles through which the fluid medium can be conveyed to the cutting tool, whereby the U-shaped element, is in the form of a U and has a first shank and a second shank so that the U-shaped element can be arranged on the protective cover with the shanks surrounding the latter and whereby the spray nozzles are arranged on the shanks. More particularly the spray nozzles can be arranged and preferably integrated on the inside of the shanks and when the shanks of the U-shaped element surround the protective cover they can align with holes made in the protective cover. Consequently no spray nozzles in the form of separate individual components are required, so that further integration of the functions into the U-shaped element is achieved.

The U-shaped can also have a hollow space which fluidically connects the spray nozzles with the connection piece. The U-shaped element can be produced in a plastic injection moulding step, whereby the hollow space is produced by an internal pressure injection method. The nozzles in the shanks can also be produce by an internal pressure injection method, said method also known as a gas internal pressure (GIP) method.

The coupling element can comprise a ring, on which a coupling lock is arranged projecting radially from the ring, and whereby the ring and the coupling lock are preferably produced in one piece. The ring forms a type of belt with which the coupling lock is rotatably arranged on the connection piece. The connection piece extends centrally through the ring, so that the central axis of the ring coincides with the axis of rotation of the connection piece.

As an additional advantage the coupling element can be arranged by means of a bayonet fitting on the U-shaped element, more particularly on the connection piece. For example, the coupling element can be mounted on the connection piece and turned until it clicks into place. The coupling element can then be arranged on the connection piece to freely rotate within its predetermined angular range, whereby between the ring of the coupling element and the connection piece at least one and preferably two sealing elements are arranged in order to prevent the fluid medium being able to emerge from a gap between the ring of the coupling element and the connection piece.

The objective of the present invention is also achieved by a handheld power tool, more particularly a cutting grinder, with a supply device, with a cutting tool and with a protective cover, which at least partially surrounds the cutting tool, whereby the supply device comprises a U-shaped element, which can be arranged on the protective cover and via which a fluid medium can be supplied to the cutting tool. It is envisaged that the U-shaped element has a connection piece on which a coupling element can be arranged, whereby a pipeline can be connected to the coupling element, via which the fluid medium can be supplied to the U-shaped element, whereby the coupling element can be turned about an axis of rotation of the connection piece.

BRIEF DESCRIPTION OF THE DRAWINGS

Further measures to improve the invention are set out in more detail below together with a description of a preferred example of embodiment of the invention with the aid of the figures.

PREFERRED EXAMPLE OF EMBODIMENT OF THE INVENTION

Figure 1:
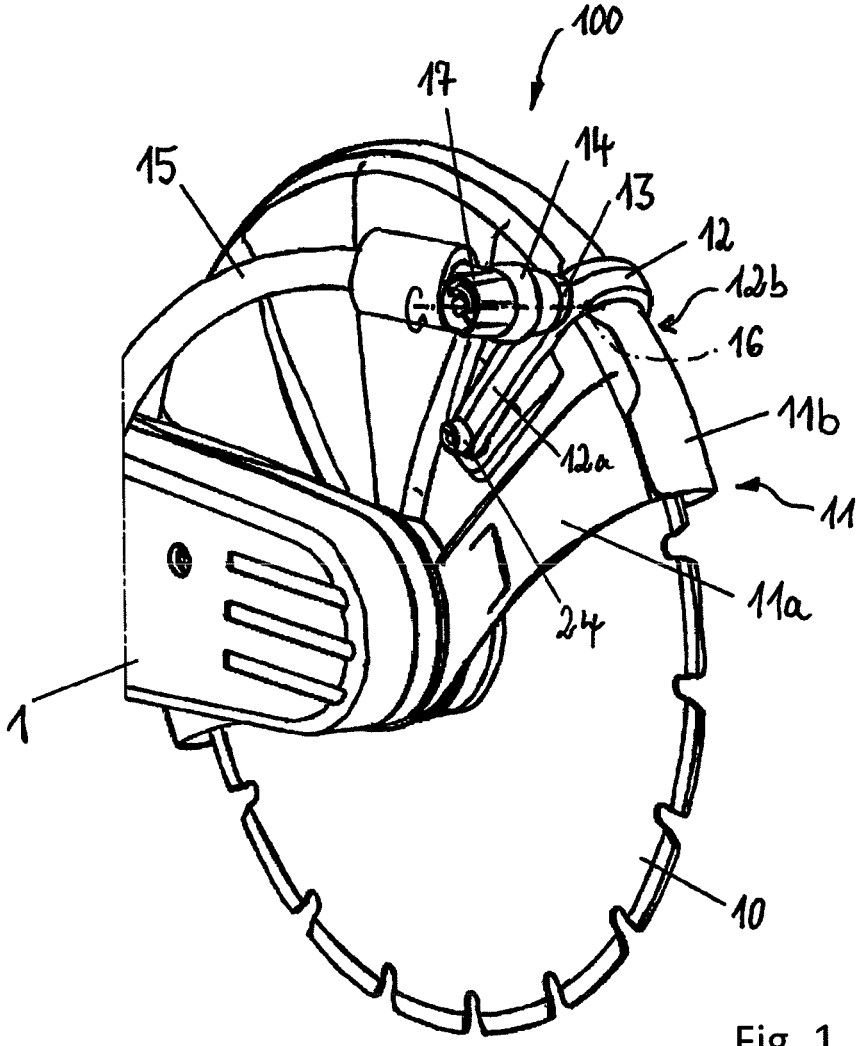
FIG. 1 shows a perspective view of a handheld power tool with a supply device in accordance with the invention for supplying a fluid medium to the power tool.

FIG. 1 shows a perspective view of an example of embodiment of the supply device 100 in accordance with the invention on a handheld power tool 1, which is shown with the cutting arm. On the cutting arm a cutting tool 10, in the form of a cutting disk, is rotatably arranged. The cutting tool 10 is protected with a protective cover 11 which surrounds the upper segment of the cutting tool 10. The protective cover 11 is made of a metallic material and consists of a first wall element 11*a* and a second wall element 11*b*. The wall elements are connected to each other in the outer circumferential area and overlap each other to form a circumferential wall.

In order to carry out the cutting process of the tool 10 in workpiece with the addition of a fluid medium, and more particularly to bind the dust, the supply device 100 is arranged on the protective cover 11 through which a fluid medium, more particularly water, can be supplied to the cutting tool 10. The supply device 100 has a U-shaped element 12 which surrounds the protective cover 11 on both sides in the form of a U. For this U-shaped element 12 essentially comprises a first shank 12*a* and a second shank 12*b*, and the first shank 12*a* is in contact with a first wall element 11*a* and the second shank 12*b* on a second wall element 11*b*. At the ends the shanks 12*a* and 12*b* are screwed to the wall elements 11*a* and 11*b* with screw elements 24.

Arranged on the U-shaped element 12 is a connection piece 13 which is produced in one piece with the U-shaped element 12 in a plastic injection moulding process. Mounted on the connection piece 13 is a coupling element 14 and the coupling element 14 can be turned about an axis of rotation 16, which simultaneously forms the middle axis of the connection piece 13. Attached to the coupling element 14 is a pipeline 15 through which the fluid medium, more particularly water, is supplied to the U-shaped element 12.

To adjust the quantity of the fluid medium flowing through the U-shaped element 12 to the cutting tool 10, the U-shaped element 12 also has a regulating valve 17. With the regulating valve 17 the flow quantity of the fluid medium can be changed or the flow of fluid medium can be switched off with the regulating valve 17. The regulating valve 17 can be manually operated, and due to its arrangement on the protective cover 11 it particularly easily accessible for a user.

Figure 2:
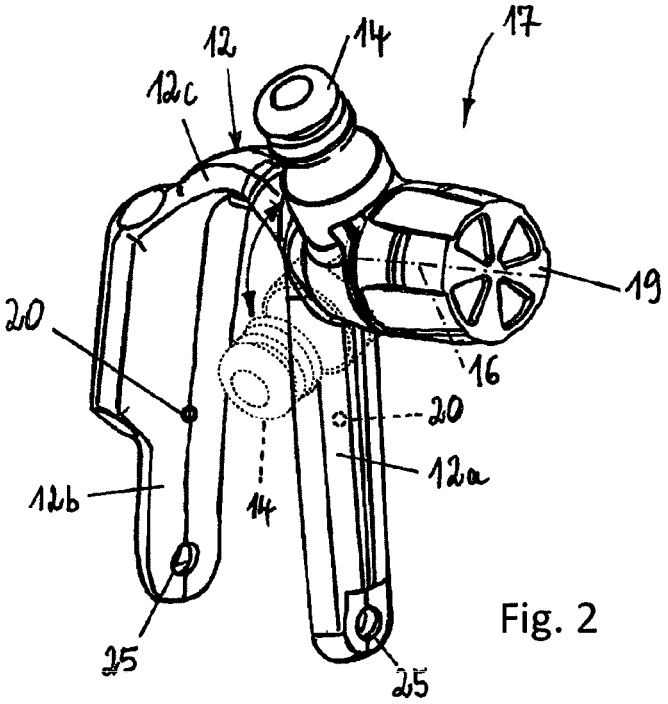
FIG. 2 shows a perspective view of a U-shaped element in accordance with the invention with a coupling element arranged on it and with a regulating valve for regulating the quantity of the fluid medium flowing through, FIG. 3 shows the U-shaped element with the features of the present invention in accordance with FIG. 2 in cross-section

FIG. 2 shows a perspective view of an example of embodiment of the U-shaped element 12 with a first shank 12*a* and a second shank 12*b*, which are connected to each other via a middle piece 12*c*. At their end the shanks 12*a* and 12*b* of the U-shaped element 12 have holes 25 through which the screw elements 24 for screwing the U-shaped element to the protective cover 11 can be passed. On the inside the shanks 12*a* and 12*b* have spray nozzles 20 and when the shanks 12*a* and 12*b* are in contact with the wall elements 11*a* and 11*b* of the protective cover 11 the fluid medium can emerge from the spray nozzles 20 and be sprayed through the holes, provided in the protective cover 11 at the appropriate point, in the accommodation space for the cutting tool in the protective cover 11.

Arranged in the transition between the middle piece 12*c* and the first shank 12*a* is the connection piece with the coupling element 14 mounted on it and the regulating valve 17. Das coupling element 14 is rotatably arranged on the U-shaped element 12 and is shown in a first position and in dashed form in a second position. The rotation is indicated by a double arrow. Also shown on the connection piece 13 is the regulating valve 17 with the manually operated actuator 19, and the actuator can be turned out the same axis of rotation 16 as the coupling element 14.

Figure 3:
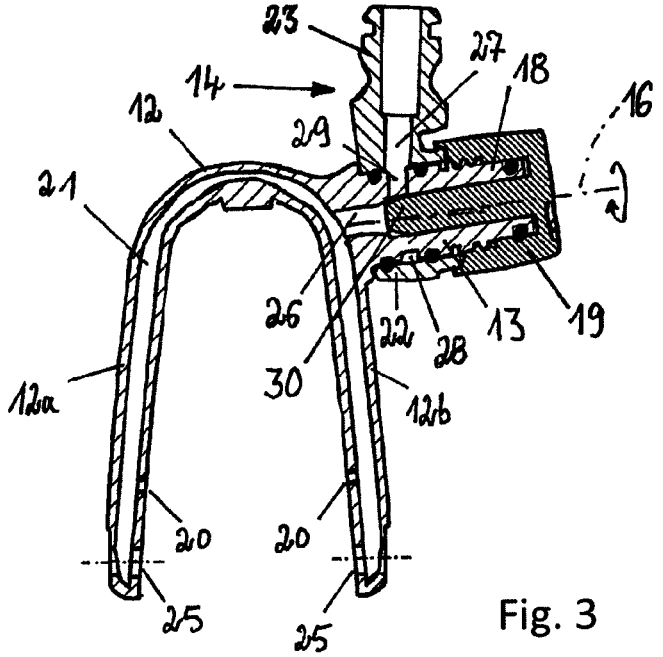

Finally, FIG. 3 show a cross-sectional side view of the U-shaped element 12. The fluid medium can be supplied the coupling element 14 via a coupling lock 23, and the coupling lock 23 becomes a ring 22 of the coupling element 14. The ring 22 surrounds the connection piece 13, which is produced in one piece with the U-shaped element 12. In the coupling element 14 a supply channel 27 is provided which opens into a ring channel 28 in the connection piece 13. If the coupling element 14 is turned about the axis of rotation 16, the fluidic connection between the supply channel 27 and the ring channel 28 is retained. Running in the direction of the middle of the connection piece 13 is a connection channel 29, which changes into a central channel 26. The fluid medium can reach the hollow 21 from the central channel 26 and emerge from the U-shaped element 12 via the spray nozzles 20.

The regulating valve 17 has an actuator 19 and the actuator 19 has a control pin 30, which can be moved into the flow area between the connection channel 29 and the central channel 26. Depending on the screw setting of the actuator 19 about the axis of rotation 16 the control pin 30 can be moved into and out of the connection in order adjust or even shut off the quantity of fluid medium flowing to the spray nozzles 20.

The hollow space 21 in the U-shaped element 12 extends to the holes 25 at the ends of the shanks 12*a* and 12*b*. Through using the screw elements 24 in accordance with the illustration in FIG. 1, sealing of the holes 25 is achieved so that the fluid medium can no longer emerge from them.

Figure 4:
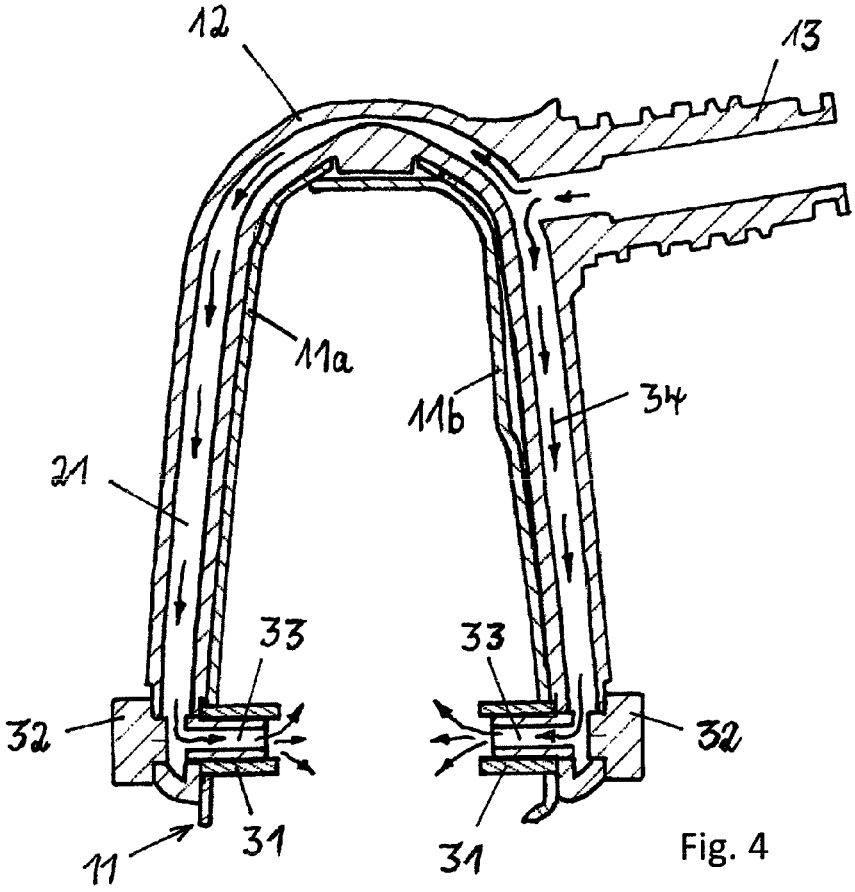
FIG. 4 shows a cross-section of a further example of embodiment of arranging a U-shaped element on the protective cover.

FIG. 4 shows a further example of embodiment of arranging a U-shaped element 12 on the protective cover 11. The protective cover 11 has insert sleeves 31 which are pressed into the wall elements 11*a* and 11*b* and into which nozzle screw 32 are screwed. The nozzle screws 32 are designed with spray channels 33, through which the fluid medium can enter the tool space, whereby the nozzle screws 32 also fulfil the function of screwing the U-shaped element 12 to the protective cover 11. This results in a fluid path 34 for the fluid medium, starting from the connection piece 13 into the hollow space 21 whereby the medium can finally emerge from the hollow space 21 into the relevant spray channel 33 of the nozzle screws 32 in order to reach the tool space.

The invention is not restricted to the preferred example of embodiment set out above. Rather, a number of variants are conceivable, which make use of the described solution even in fundamentally different types of embodiment. All features and/or advantages in accordance with the claims, the description or the drawings, including design details or spatial arrangements, can be essential to the invention in themselves or in various combinations.

REFERENCE LIST

100 Supply device
1 Handheld power tool
10 Cutting tool
Protective cover
11*a* First wall element
11*b* Second wall element
12 U-shaped element
12*a* First shank
12*b* Second shank
12*c* Middle piece
13 Connection piece
14 Coupling element
15 Pipeline
16 Axis of rotation
17 Regulating valve
18 Valve pintle
19 Actuator
20 Spray nozzle
21 Hollow space
22 Ring
23 Coupling lock
24 Screw element
25 Hole
26 Central channel
27 Supply channel
28 Supply channel
29 Connection channel
30 Control pin
31 Insert sleeve
32 Nozzle screw
33 Spray channel
34 Fluid path

What is claimed is:

1. A supply device for a handheld power tool having a cutting tool and a protective cover at least partially surrounding the cutting tool, the supply device comprising:

a U-shaped element configured to be arranged on the protective cover and for supplying a fluid medium to the cutting tool, wherein the U-shaped element has a connection piece for arranging a coupling element thereon, the coupling element is configured to connect to a pipeline for supplying the fluid medium to the U-shaped element through the connection piece, the connection piece has a central axis that is oblique to a central axis of the pipeline, and the pipeline and the coupling element are configured to be rotatable with respect to the connection piece about the central axis of the connection piece.

2. The supply device in accordance with claim 1, wherein the connection piece is designed in one piece with the U-shaped element.

3. The supply device in accordance with claim 1, wherein the connection piece has a regulating valve to adjust a flow quantity of the fluid medium through the supply device, and the fluid medium is water.

4. The supply device in accordance with claim 3, wherein the regulating valve comprises a valve pintle and a manually operated actuator whereby the valve pintle is defined by a part of the connection piece.

5. The supply device in accordance with claim 4, wherein the actuator is configured to be turned about the central axis of the connection piece.

6. The supply device in accordance with claim 1, wherein the U-shaped element has at least one spray nozzle for supplying the fluid medium to the cutting tool, the U-shaped element has a first shank and a second shank so that the U-shaped element is arranged on the protective cover with the first and second shanks surrounding the latter, and the at least one spray nozzle is arranged on at least one of the first and second shanks.

7. The supply device in accordance with claim 6, wherein the connection piece is arranged on the U-shaped element in a transition area between the first and second shanks at a distance from the at least one spray nozzle.

8. The supply device in accordance with claim 6, wherein the U-shaped element has a hollow space which fluidically connects the spray nozzles with the connection piece.

9. The supply device in accordance with claim 1, wherein the coupling element has a ring on which a coupling lock is arranged projecting radially from the ring, and the ring and the coupling lock are one piece.

10. The supply device in accordance with claim 1, wherein the coupling element is connected to the connection piece by a bayonet fitting.

11. A handheld power tool having a supply device, a cutting tool and a protective cover at least partially surrounding the cutting tool, the supply device comprising:

a U-shaped element arranged on the protective cover for supplying a fluid medium to the cutting tool, wherein the U-shaped element has a connection piece for arranging a coupling element thereon, a pipeline for supplying the fluid medium to the U-shaped element through the connection piece is connected to the coupling element, the connection piece has a central axis that is oblique to a central axis of the pipeline, and the pipeline and the coupling element are rotatable with respect to the connection piece about the central axis of the connection piece.

12. The handheld power tool in accordance with claim 11 wherein the connection piece is one piece with the U-shaped element.

* * * * *